US005337968A

United States Patent [19]

De Bin et al.

[11] Patent Number: 5,337,968

[45] Date of Patent: Aug. 16, 1994

[54] APPARATUS FOR ROLLING UP WEB MATERIAL

[75] Inventors: Rene F. De Bin, St. Gillis Waas; Emiel Lambrecht, Gijzegem-Aalst, both of Belgium

[73] Assignee: FMC Corporation, Chicago, Ill.

[21] Appl. No.: 37,502

[22] Filed: Mar. 25, 1993

Related U.S. Application Data

[63] Continuation of Ser. No. 679,452, Apr. 2, 1991, abandoned.

[30] Foreign Application Priority Data

Apr. 4, 1990 [DE] Fed. Rep. of Germany ..... 4010894

[51] Int. Cl.[5] ..... B65H 19/26; B65H 19/30

[52] U.S. Cl. ..... 242/521; 242/532.2; 242/533.6; 242/541.1

[58] Field of Search ..... 242/56 R, 56 A, 74; 225/100, 106

[56] References Cited

U.S. PATENT DOCUMENTS

| | | | |
|---|---|---|---|
| 2,385,692 | 9/1945 | Corbin et al. | 242/65 |
| 2,520,826 | 8/1950 | Beck | 242/65 |
| 2,575,631 | 11/1951 | Link | 242/65 |
| 3,527,424 | 9/1970 | Goldman | 242/74 |
| 3,743,199 | 7/1973 | Karr et al. | 242/65 |
| 3,908,924 | 9/1975 | Schulze | 242/56 A X |
| 4,541,583 | 9/1985 | Forman et al. | 242/56 A |
| 4,630,783 | 12/1986 | Mulfarth | 242/56 A |
| 4,715,552 | 12/1987 | Matsumoto | 242/56 A |

FOREIGN PATENT DOCUMENTS

| | | | |
|---|---|---|---|
| 238030 | 4/1959 | Australia | 242/56 A |
| 0077400 | 4/1982 | European Pat. Off. . | |
| 404542 | 1/1969 | Japan | 242/56 A |
| 1227554 | 6/1967 | United Kingdom . | |
| 1398536 | 8/1972 | United Kingdom . | |

*Primary Examiner*—John M. Jillions

*Attorney, Agent, or Firm*—Henry C. Query, Jr.; Richard B. Megley

[57] ABSTRACT

In an apparatus for rolling up web material which comprises a disk or turret rotatably mounted on a stationary frame and a plurality of mandrels rotatably mounted to the disk, each mandrel being indexable to each of a take-up position, a waiting position and a removal position through selective rotation of the disk, the improvement which comprises a source of compressed air connected to the frame adjacent the removal position, a separate vacuum tube apparatus connected to the frame adjacent the waiting position and being axially movable toward and away from the waiting mandrel, a vacuum pump connected to the vacuum tube apparatus for creating a vacuum in the vacuum tube apparatus, the mandrels each comprising a longitudinal bore extending from an open end thereof and a plurality of radial nozzles communicating with the longitudinal bore, wherein the vacuum tube apparatus is selectively movable into contact with the open end of the waiting mandrel so that the vacuum is communicated through the nozzles to thereby draw the web material around the waiting mandrel, and wherein the source of compressed air is communicated with the mandrel in the removal position so that compressed air is communicated through the nozzles to thereby assist in removing the completed roll of web material from that mandrel.

6 Claims, 2 Drawing Sheets

APPARATUS FOR ROLLING UP WEB MATERIAL

This application is a continuation of application Ser. No. 07/679,452, filed Apr. 2, 1991, now abandoned.

BACKGROUND OF THE INVENTION

1. Field of the Invention

This invention pertains to a roll up winder on a bag producing machine. The roll up winder includes a plurality of winding mandrels at a winding station, The mandrels are indexed to one of at least three positions to start a roll of web material. In a preferred embodiment, the web material is a web of plastic bags connected together at perforations into a continuous web. After the roll is started the subject mandrel is indexed to a second position where a full roll of bags is accumulated, The mandrel is finally indexed to a third position where the full roll is elected from the subject mandrel.

This invention has to do with an improvement to the so called turret winder described above to make the turret winder perform more consistently and to produce a more uniform roll of product. The improvements presented in this application revolve around the cycled use of vacuum and air pressure to assist in starting the continuous web of bags onto the mandrel in the first or roll starting position and then using air pressure to assist in the removal of the completed roll of bags from the mandrel in the third or roll discharge position of the turret.

SUMMARY OF THE INVENTION

A turret style windup for use in winding up rolls of long lengths of a continuous web includes several windup mandrels. In a preferred embodiment these windup mandrels are provided with a plurality of ports or apertures that communicate with a central bore cavity in each of the mandrels. These ports will be connected to either a source of vacuum relative to and acting on the web of material being wound up or a source of pressure tending to urge a roll of rolled up web away from the mandrel to assist in the roll being pushed off or ejected from the mandrel.

The mandrels are mounted to a turret plate through bearings such that the turret plate can index from one position to a second position without the drive means for each mandrel following the mandrel. However the inboard end of the mandrel, more properly a rotary seal associated with the inboard end of the mandrel, will align with a source of fluid pressure or a source of fluid vacuum, depending on the position of the mandrel, to either pressurize or draw a vacuum through the ports of the mandrel.

Drawing a vacuum through the ports when the web is started onto the mandrel assists the web start and will minimize the "off-tracking" or "slewing" of the web (such off-tracking could result in a partially "telescoped" roll) as it is being started.

Delivering pressurized flow through the ports when the mandrel is in its third position assists in the "push-off" or removal of the rolled up web by providing a cushion of air between the mandrel and the roll.

BRIEF DESCRIPTION OF THE DRAWING FIGURES

In the drawing figures presented herewith:

DETAILED DESCRIPTION OF THE INVENTION

Figure 1:
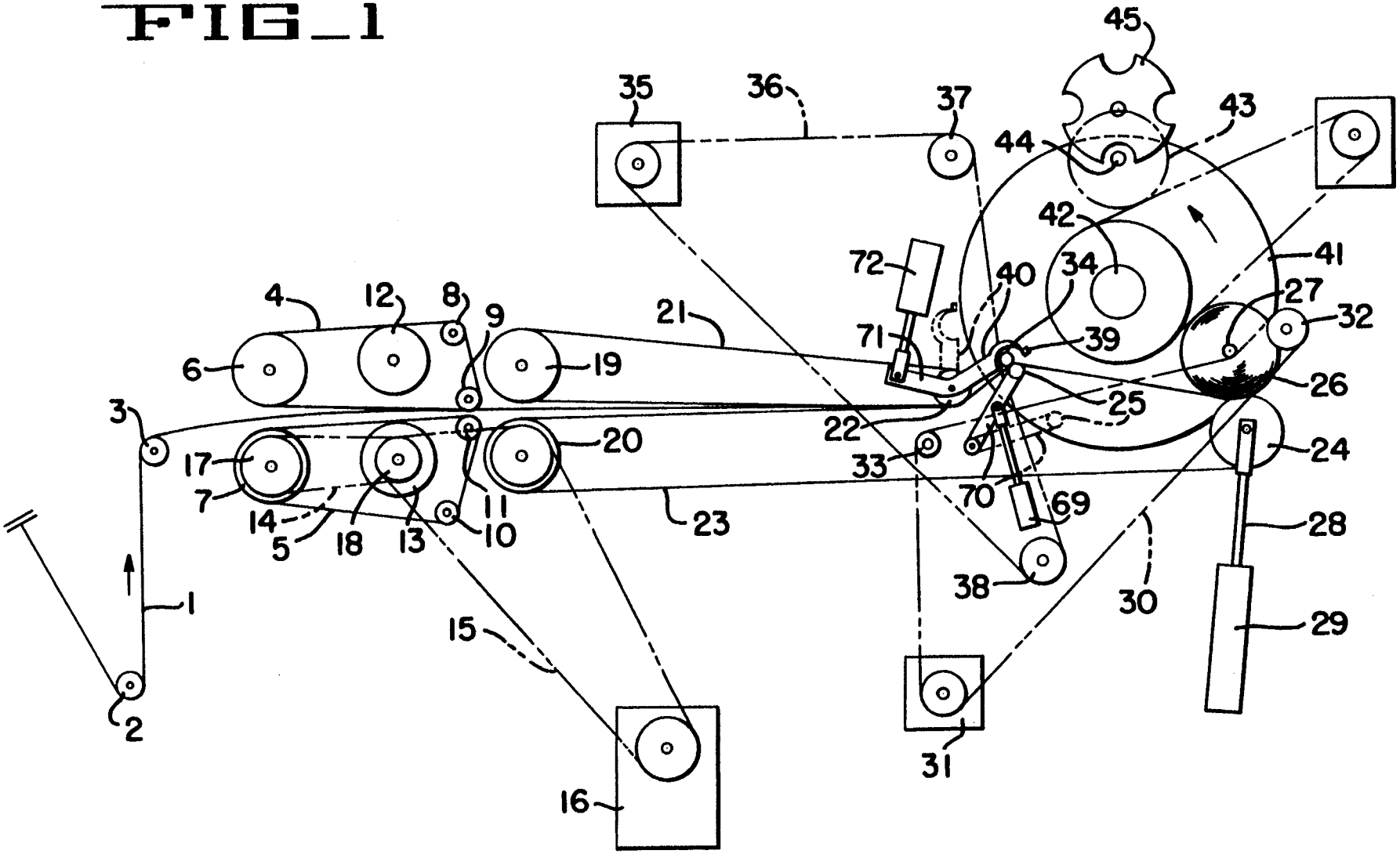
FIG. 1 is a schematic or pictorial representation of a turret windup system incorporating the invention.

The invention will be easily understood after a reading of the following description in conjunction with a perusal of the drawing figures.

A general appreciation of the invention and the environment wherein it resides is presented in FIG. 1.

In this figure a web of material 1 is shown passing around a guide roller 2 and a compensator roller before following a generally horizontal path through a web separator section to the turret winder zone. The web of material in a preferred embodiment would be a continuous length of folded bags connected together at a perforation which is formed in the web usually after the web is folded and before guide roller 2. Of course the web could be other types of products such as flat stack, tube stack, composite materials or any other configuration or product that could be beneficially rolled up on a mandrel.

After the compensator roller 3, the web 1 which has been perforated at intervals corresponding to desired segment length, comes within the range of guide cords 4 and 5 which are entrained on the rollers 6 and 7 and around rollers 8/9 and 10/11. Disposed between those rollers are rollers 12 and 13 which are used to speed up the web to separate it at perforations as will be explained further on.

The rollers 7 and 13 are driven by means of toothed belts 14 and 15 by the drive member 16. The drive of the two rollers 7 and 13 is effected by means of the two toothed belt pulleys 17 and 18 which, by means of their different diameters and the relative ratio resulting therefrom, ensures that the roller 13 rotates somewhat faster than the roller 7. The other rollers 6, 8, 9, 10 and 11 are merely driven by friction provided through the guide cords. The roller 12 is driven by roller 13 by means of a gear drive not illustrated.

As can be seen in FIG. 1, the roller 13 maintains a distance from the roller 12 and therefor the two faster running rollers, namely 12 and 13, have no normal influence on the travel of the web material 1. However these rollers are used to separate the web at the previously mentioned perforations. As a result of abruptly bringing the roller 13 up to the roller 12, the web material caught between the nip of rollers 13 and is speeded up relative to the normal web speed and the speed of the web in the nip between rollers 6 and 7 so that a perforation or prepared point of separation present between the rollers 6 and 7 and 12 and 13 tears apart at the perforation and the beginning of the length of web following the point of separation (that is, the length of web still between the rollers 6 and 7) ends up separated a short distance away from the length of web running on ahead of the perforation or the tail end of the previous web segment.

From this separation section the further feeding of the web material is then effected by drive provided by rollers 19 and 20 of which roller 20 is driven by the drive member 16. Both rollers 19 and 20 turn at the same speed. The feed speed of the rollers 19 and 20 corresponds to that of the rollers 6 and 7.

A conveyor cord 21, or set of conveyor cords, is entrained around rollers 19 and 22. Roller carries a conveyor belt 23 which is also entrained around roller 24. This conveyor belt 23 gives the web material 1 secure support over a relatively long length as the web progresses to the turret winder. Conveyor belt 23 is taken over a guide roller 25 which the conveyor belt 23 reaches after passing under a roller 22 and before the belt reaches roller 24. The guide roller 25 is deflectable from a first position to a second position to deflect the conveyor belt 23 toward a first position mandrel.

During the winding operation the web material 1 is guided in the manner described above to within the range of the guide roller 25, the web being securely held between the conveyor cords such as 21 and the conveyor belt 23. Downstream of the guide roller 25, the web material comes directly to the package 26 which is being wound up by the take-up mandrel 27 in the second position of the turret windup three positions (in this embodiment). The take-up mandrel in this position is driven, in a well known manner, at such a speed that the surface speed of the package 26 corresponds to the feed speed of the web material in the region of conveyor cords 21 and conveyor belt 23. While the package is being wound on the second position take-up mandrel, roller 24, which is mounted at the end of piston rod 28 of the piston and cylinder unit 29, is urged against the conveyor belt 23 causing it to remain close to or contact with the package of web material being wound up regardless of the diameter of the package 26.

The drive of the take-up mandrel 27 is provided by means of a toothed belt 30 which is driven by drive member 31. The toothed belt 30 wraps around the guide pulleys 32 and 33 while it partially embraces a toothed belt pulley fixed to the take-up mandrel 27 thereby driving the take-up mandrel in the second position.

During the winding operation as a package or roll of web material 26 is being formed on the or take-up position take-up mandrel, the waiting mandrel 34, waits in the first or waiting position as shown in FIG. 1. The waiting mandrel 34 is positioned upstream from the take-up mandrel 27 position as can be seen. The waiting mandrel 34 is rotated and driven by means of drive member 35 which drives a toothed belt 36 entrained around guide pulleys 37 and 38 and proximate to the waiting mandrel 34. The toothed belt engages the waiting mandrel 34 so that it is driven by belt 36.

The operation of winding up the material web at the turret winder will be apparent from the following disclosure. The operation starts when the rolling up function is completed or nearly completed on the take-up mandrel in the second position. When, or just before, the package reaches its full diameter a new roll or package will be started on the waiting mandrel in the first position.

For the transfer of the web material 1 to the waiting mandrel 34, the point of separation between the trailing end of the web and the subsequent new leading edge of the web previously described, is used. When the point of separation reaches the guide roller 25 location and the end of the currently being wound web has passed the location on the belt above the guide roller 25, the guide roller 25 is pivoted up out of its normal position of repose illustrated in broken lines (while the roll 26 is still growing in diameter) into the solid line position. The guide roller 25 lifts the leading edge of the web which is on the conveyor with the conveyor, of course. The space between the trailing end of the previous web and the leading edge of the new web to be wound up in a roll is proximate and below the waiting mandrel 34. Urging the leading edge up to, and into engagement with, the waiting mandrel 34 takes place by means of well known techniques including directing a burst of compressed air, originating from the compressed air pipe 39 which is provided with appropriate ejection nozzles and is fitted to the end of the bell crank arm 40. The direction of this burst of compressed air is such that the leading edge of the web is lifted from the conveyor belt 23 and pressed against the waiting mandrel 34.

After the web is started on the rotating waiting mandrel 34 the indexing of the waiting mandrel 34 in the first position is accomplished and the waiting mandrel becomes the take-up mandrel 27 in the second turret position. This indexing of the turret is accomplished in a well known manner by rotating the disc 41 which is axially carried on shaft 42. During the rotation of the disc (in the direction of the arrow), the waiting mandrel 34 is indexed to the take-up position, as stated above, and the take-up mandrel which occupied the second position is indexed to the removal position, or third position 43 of the turret winder. Here the full roll or package, illustrated as a broken line representation, is urged from its winding mandrel 44. Normally it is well known to use a pusher plate 45, which is provided with recesses, to push the package off the mandrel but in the instant invention the removal of the roll is aided by means of a burst of compressed air from any known source which, via the radial nozzles provided in the mandrels 34, 27 and 44 (see FIG. 2), lifts the full package slightly from the winding mandrel 44 so that the full package can be withdrawn axially from the winding mandrel 44. As a result of this indexing of the disc 41 the free winding mandrel 44 in the third position moves to the waiting or first position 34 so that an empty mandrel is available as a waiting mandrel in the first position for the next transfer operation for the beginning of a new length of web material.

Returning to the starting operation again, the lifting movement of the guide roller 25 is effected by means of the piston and cylinder unit 69 which, with its ram, moves the supporting arm 70 for the guide roller 25 appropriately up and down. During the rolling up on the take-up mandrel 27, the supporting arm 70 is in the position shown in broken lines.

In order that the compressed air pipe 39 with the arm 40 carrying it may not be in the way during the rotation of the disc 41, the arm 40 is mounted on the same spindle as the roller 22, via the bell crank lever 71, the end of which is suspended on the ram of the piston and cylinder unit 72. As a result of actuation of the piston and cylinder unit 72, bell crank lever 71, arm 40 and compressed air pipe 39 are pivoted accordingly during the indexing of the disc 41 such that the compressed air pipe with its arm 40 assumes the position shown in the broken line presentation.

During the movement of the waiting mandrel 34 from the first position to the second position, its drive changes from the toothed belt 36 to the toothed belt 30. In order that these toothed belts may each be able to follow on or maintain drive tension or to yield, each of the associated guide rollers respectively 37 or 32 are resiliently mounted.

Figure 2:
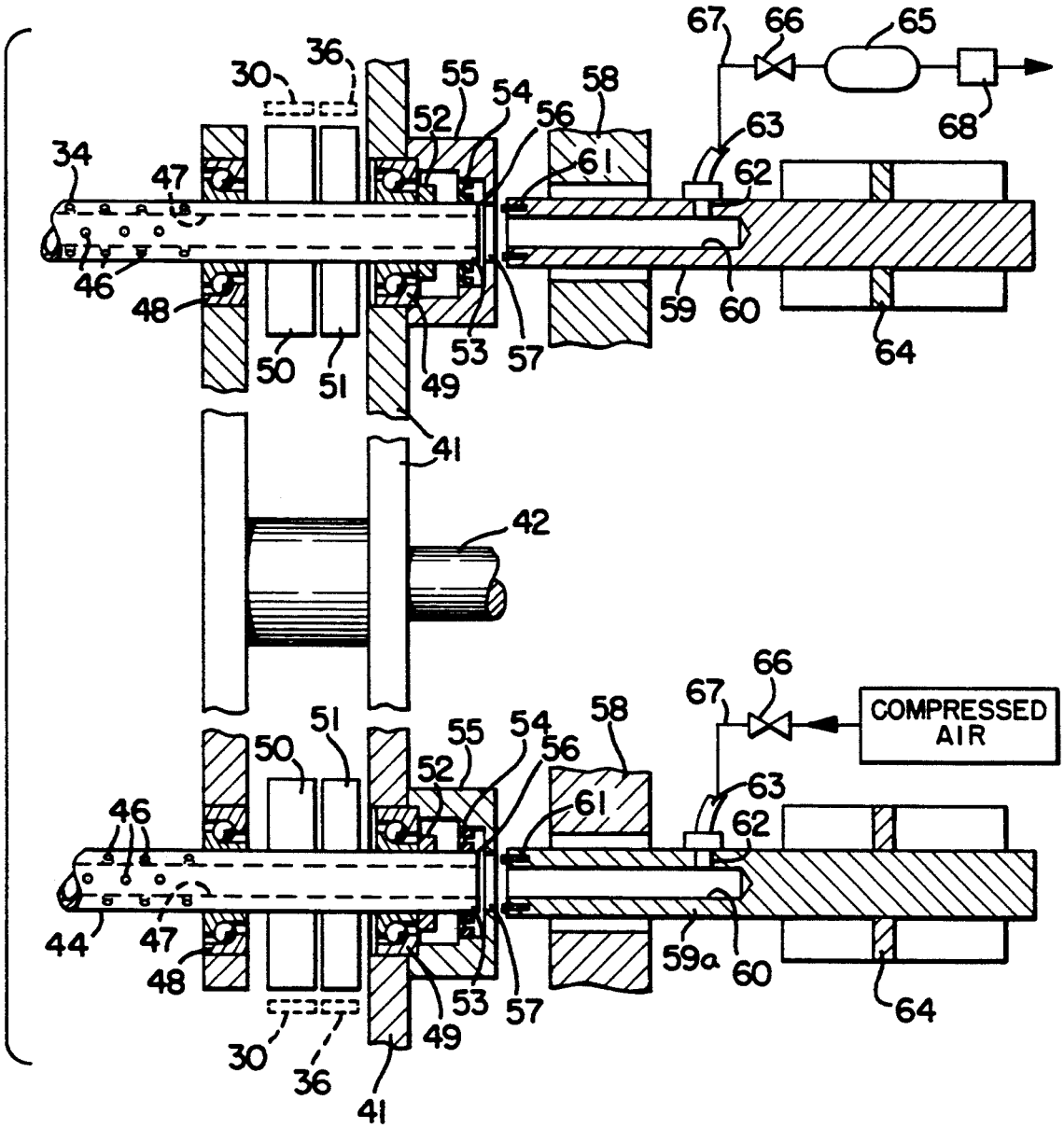
FIG. 2 is a pictorial representation, with some parts broken away and sectioned, showing the pressure and vacuum system of the invention.

In FIG. 2, a mandrel is shown in the first or waiting position, thus it being, for illustrative purposes the waiting mandrel 34.

Like each of the other mandrels, two others in a preferred embodiment, the waiting mandrel 34 is provided with the radial nozzles or apertures 46 which are arranged in a plurality of axially directed rows substantially over the entire length of the waiting mandrel 34 and are uniformly distributed over the surface of the waiting mandrel. The nozzles 46 are in communication with the longitudinal bore 47 running through the mandrel.

At the inboard end of the mandrel 34 two roller bearings, 48 and 49 support the mandrel. These bearings are mounted in and supported by the disc 41. Between the two roller bearings 48 and 49 there are two toothed belt pulleys 50 and 51 which are rigidly connected to the waiting mandrel 34 and of which one can be driven by the toothed belt 36 and the other by the toothed belt 30 (see FIG. 1).

In the first position, as already explained in connection with FIG. 1, the drive of the waiting mandrel 34 is provided by the toothed belt 36 whereas after rotation or indexing of the disc 41, the take-up mandrel 27, that mandrel in the second position, is driven in the winding position by the toothed belt 30.

The inboard end of the waiting mandrel 34 projects through the stop ring 52 which provides lateral containment or restraint of the rolling bearing 49 and forms the mandrel end 53 which is surrounded by the rotary seal 54. The rotary seal 54 ensures that the waiting mandrel 34 rotating at more than two thousand revolutions per minute is sealed off from the stationary holder 55 which is secured to the disc 41 in a manner not illustrated. The stationary holder 55 engages over the front face 56 of the mandrel end 53 and is provided with a central aperture or opening 57 coaxial with the longitudinal bore 47.

When in the first position, the holder 55 is situated opposite the axially movable vacuum tube 59 which is mounted for movement therethrough in a supporting wall 58. The interior bore 60 of the axially movable tube is in alignment with the opening 57 of the stationary holder 55 when the mandrel is indexed to the first position. The contact end of the tube, that end of the axially movable tube 59 which contacts the stationary holder when the tube is moved toward the stationary holder, is equipped with a circumferential recess in the end of the tube which houses a seal 61 such that when the axially movable vacuum tube 59 is moved into contact with the stationary holder 55 the interior bore 60 of the tube 59 is in sealed communication with the opening 57.

The wall of the tube 59 is provided with an access aperture 62 into which a supply pipe 63 for the supply of vacuum is fitted. The tube 59 also forms the piston and rod of the piston and cylinder unit 64 which is actuated pneumatically or hydraulically in a well known manner to move the seal carrying end of the tube axially forwards or backwards to either contact or be removed from contact with the stationary holder 55.

The operation of this aspect of the invention is as follows. With the mandrel in the first position, when the leading edge of a length of web approaches the waiting mandrel as previously explained in connection with FIG. 1, the control of the whole apparatus, which is not necessary to be disclosed herein as it is well known in the art, signals the piston and cylinder 64 to engage the axially movable tube 59 to engage the holder 55 and further signals vacuum to be provided through the tube and through the radial nozzles 46 assisting in holding the web material against the waiting mandrel 34. As a result of the adjustment of the vacuum pressure supplied to the bore 60 of the tube 59, the vacuum is effected more or less gently so that a corresponding friction results in a controlled manner between the surface of the waiting mandrel 34 and the material of the web 1. The peripheral speed of the waiting mandrel 34 is greater than the feed speed of the web of material 1 and is effective uniformly from the time the leading edge is first started on the mandrel and during the web's entrainment on the mandrel. The result of this vacuum assisted entrainment of the web on the fast moving mandrel is that the web of material is transferred from the conveyor belt 23 to the waiting mandrel 34 without any jerking motions. Furthermore, the length of the web material thus taken up smoothly on the waiting mandrel 34 doesn't have a tendency to wander back and forth on the waiting mandrel 34, and thus the eventual roll of web that is wound up is not telescoped and the final package has uniformly rolled up layers of web material.

The vacuum drawn via the supply pipe 63 is provided by means of an adjustable vacuum pump 68 of conventional design. The vacuum pump 68 is connected to a surge tank 65 which serves to ensure that when the surge tank 65 is connected to the supply pipe 63 no excessive fluctuations in vacuum pressure occur. The connection of surge tank 65 to supply pipe 63 includes the provision of a valve 66 which, as explained above, is also actuated by the normal timing controls used to index the winder and merely opens or closes the passage 67 between the tank 65 and the supply pipe 63.

When winding mandrel 44 is indexed to the third position, holder 55 is situated opposite the source of compressed air (FIG. 2). The pressurized air is communicated through bore 47 and nozzles 46 to the rolled up web material to thereby lift the web material slightly radially away from winding mandrel 44 so that the rolled up web material can be more easily withdrawn therefrom.

The pressurized air is communicated to winding mandrel 44 through an air tube **59*a*, which is identical to vacuum tube 59 and operates is a similar fashion to selectively connect the source of compressed air to winding mandrel 44. In FIG. 2, the same reference numbers are used to denote the elements of air tube 59*a* and its associated structure which are identical to the elements of vacuum tube 59** and its associated structure.

The best mode for practicing this invention has been presented herein, however, minor modifications, such as the design of the seal between the tube and the stationary holder could be undertaken without departing from the scope of the invention as set forth in the following claims.

What is claimed is:

1. In combination with an apparatus for rolling up web material, particularly bags consisting of plastic films and connected together in strip form, which comprises a disk rotatably mounted on a stationary frame, means for feeding the web material toward the disk, and means for transversely severing the web material before it reaches the disk; wherein the disk comprises a plurality of mandrels rotatably mounted thereto, each mandrel being indexable to each of a take-up position, a waiting position and a removal position through selective rotation of the disk, thereby defining the mandrels as a take-up mandrel, a waiting mandrel and a winding mandrel, respectively, when the mandrels are indexed to each of the three positions; and wherein the web material is rolled up upon the take-up mandrel until a maximum thickness of web material has accumulated on the mandrel, whereupon the web material is severed by the severing means and the web material is fed to the waiting mandrel and rolled up upon the waiting mandrel until a minimum thickness of web material has accumulated on the waiting mandrel, whereupon the disk rotates to transfer the winding mandrel to the waiting position, the waiting mandrel to the take-up position, and the take-up mandrel to the removal position for removal of the rolled up web material, the improvement comprising:

a vacuum tube connected through a support wall to the frame adjacent the waiting position of the waiting mandrel, the vacuum tube being axially movable toward and away from the waiting mandrel;

vacuum pump means connected to the vacuum tube for creating a vacuum in the vacuum tube;

the mandrels each comprising a longitudinal bore extending from an open end thereof and a plurality of radial nozzles communicating with the longitudinal bore;

wherein the vacuum tube is selectively movable into contact with the open end of the waiting mandrel so that the vacuum is communicated through the nozzles to thereby draw the web material around the waiting mandrel.

2. The apparatus of claim 1, wherein the vacuum tube comprises a piston connected to a tube having a longitudinal bore extending from an open end thereof and the vacuum pump means is connected to the bore, and wherein the piston is selectively actuatable to bring the open end of the tube into contact with the open end of the waiting mandrel to allow for communication of the vacuum to the nozzles.

3. The apparatus of claim 1, further comprising a stationary holder connected to the disk over the open end of each mandrel and a rotary seal mounted within each holder around the open end of each mandrel, each holder comprising an opening in axial alignment with the bore of each mandrel to, together with the rotary seal, define a conduit for the vacuum between the vacuum tube and the bore of the mandrel when the vacuum tube is moved into contact with the holder.

4. In combination with an apparatus for rolling up web material, particularly bags consisting of plastic films and connected together in strip form, which comprises a disk rotatably mounted on a stationary frame, means for feeding the web material toward the disk, and means for transversely severing the web material before it reaches the disk; wherein the disk comprises a plurality of mandrels rotatably mounted thereto, each mandrel being indexable to each of a take-up position, a waiting position and a removal position through selective rotation of the disk, thereby defining the mandrels as a take-up mandrel, a waiting mandrel and a winding mandrel, respectively, when the mandrels are indexed to each of the three positions; and wherein the web material is rolled up upon the take-up mandrel until a maximum thickness of web material has accumulated on the mandrel, whereupon the web material is severed by the severing means and the web material is fed to the waiting mandrel and rolled up upon the waiting mandrel until a minimum thickness of web material has accumulated on the waiting mandrel, whereupon the disk rotates to transfer the winding mandrel to the waiting position, the waiting mandrel to the take-up position, and the take-up mandrel to the removal position for removal of the rolled up web material the improvement comprising:

a vacuum tube connected through a support wall to the frame adjacent the waiting position of the waiting mandrel, the vacuum tube being axially movable toward and away from the waiting mandrel;

a vacuum pump means connected to the vacuum tube for creating a vacuum in the vacuum tube;

the mandrels each comprising a longitudinal bore extending from an open end thereof and a plurality of radial nozzles communicating with the longitudinal bore;

wherein the vacuum tube is selectively movable into contact with the open end of the waiting mandrel so that the vacuum is communicated through the nozzles to thereby draw the web material around the waiting mandrel;

an air tube connected through a support wall to the frame adjacent the removal position of the winding mandrel, the air tube being axially movable toward and away from the winding mandrel;

compressed air means connected to the air tube for delivering compressed air to the air tube;

wherein the air tube is selectively movable into contact with the open end of the winding mandrel so that the compressed air is communicated through the bore and the nozzles to push the rolled-up web material radially away from the winding mandrel.

5. The apparatus of claim 4, further comprising a stationary holder connected to the disk over the open end of each mandrel and a rotary seal mounted within each holder around the open end of each mandrel, each holder comprising an opening in axial alignment with the bore of each mandrel to, together with the rotary seal, define a conduit for the compressed air between the air tube and the bore of the mandrel when the air tube is moved into contact with the holder.

6. An apparatus for rolling up web material which comprises:

a disk rotatably mounted on a stationary frame;

a plurality of mandrels rotatably mounted to the disk;

the mandrels each comprising a longitudinal bore extending from an open end thereof and a plurality of radial nozzles communicating with the longitudinal bore;

means for selectively applying vacuum pressure to the radial nozzles of each of the mandrels; and means for selectively applying compressed air to the radial nozzles of each of the mandrels;

wherein the means of applying vacuum pressure comprises a vacuum tube in communication with a source of vacuum, the vacuum tube being selectively movable into contact with the open end of each mandrel; and wherein the means for applying compressed air comprises an air tube in communication with a source of compressed air, the air tube being selectively movable into contact with the open end of each mandrel.

* * * * *